United States Patent [19]

Steinbrecher

[11] 4,258,527

[45] Mar. 31, 1981

[54] METHOD OF AND AN INSTALLATION FOR THE AUTOMATIC PACKING OF STACKS OF ARTICLES

[76] Inventor: Bernhard Steinbrecher, Südendstr. 54, D-7500 Karlsruhe, Fed. Rep. of Germany

[21] Appl. No.: 43,493

[22] Filed: May 29, 1979

[30] Foreign Application Priority Data

May 29, 1978 [CH] Switzerland ..... 5859/78

[51] Int. Cl.[3] ..... B65B 35/50

[52] U.S. Cl. ..... 53/447; 53/448; 53/538; 53/542; 53/252

[58] Field of Search ..... 53/443, 447, 448, 537, 53/538, 542, 252, 157

[56] References Cited

U.S. PATENT DOCUMENTS

| | | | |
|---|---|---|---|
| 3,370,549 | 2/1968 | Livingston | 53/252 X |
| 3,593,837 | 7/1971 | Loomis | 53/537 X |

FOREIGN PATENT DOCUMENTS

| | | | |
|---|---|---|---|
| 490655 | 2/1953 | Canada | 53/447 |
| 954139 | 11/1958 | Fed. Rep. of Germany . | |
| 1228553 | 10/1966 | Fed. Rep. of Germany . | |
| 7727611 | 3/1978 | Fed. Rep. of Germany . | |
| 2031168 | 11/1970 | France . | |

*Primary Examiner*—Horace M. Culver
*Attorney, Agent, or Firm*—Laubscher & Laubscher

[57] ABSTRACT

In a method of automatically packing articles produced in at least two machine units and filled by means of a cartoning machine into cartons or boxes the following steps are provided: the articles are piled up in the machine units to form stacks of articles, the stacks of articles are transferred to a conveyor means operating in cycles, conveyed to the cartoning machine and finally pushed into a carton or box transversely of the direction of transport.

In a preferred installation for carrying out the method a stacking device forming stacks of articles and a transverse pusher are associated with each machine unit. The machine units are interconnected by a common compartmental conveyor moved in cycles and having compartments of the length of a stack of articles. At the end of the compartmental conveyor a cartoning machine is arranged with which another transverse pusher is coordinated so as to be aligned with the compartments of the compartmental conveyor at standstill.

5 Claims, 5 Drawing Figures

METHOD OF AND AN INSTALLATION FOR THE AUTOMATIC PACKING OF STACKS OF ARTICLES

DESCRIPTION OF THE PRIOR ART

The invention relates to a method of automatically packing articles produced in at least two machine units, filled by means of a cartoning machine into boxes which are then closed to form a package.

Articles, such as small bags or sacks or pouch-like structures filled with a certain amount of a material are placed in cartons or boxes which are then glued together to form packages. As the articles mentioned are required in great numbers, it is also customary to use boxes with a plurality of rows of articles. In this case the articles are put by hand into the boxes, and carton walls must be placed between the individual rows of articles to prevent the individual rows from gliding into each other.

Special machines are used for producing the articles, i.e. for forming the bag or pouch-like structures, for filling them with metered amounts of a material, and for closing the structures. If single-row packages only are produced, a cartoning machine can be employed which is connected to the downstream end of the machine producing the articles. A cartoning machine in the present context is understood to be a machine in which the cartons or boxes fed to the machine are erected, filled, and closed.

If the production of a single article producing machine is no longer sufficient, it is obvious to install a second unit including a cartoning machine so as to double the production potential. For further increase of production, further machine units are purchased and installed. This way of achieving higher production rates has the advantage that upon failure of one machine, the other machines can keep up their output. Yet it is a disadvantage that each additional machine installed has its own accessories with a corresponding large space requirement and, possibly, only incomplete utilization. This solution consequently is unfavorable under aspects of the costs.

A machine designed for large-scale production is less expensive, provided its capacity can be fully put to use. It is disadvantageous, however, that in case of trouble with a machine, production will be shut down completely.

It must further be kept in mind that with all known solutions manual labor accounts for a relatively large share in filling the articles into the cartons or boxes, in particular in case of packages having two or more rows of articles.

SUMMARY OF THE INVENTION

It is, therefore, the object of the invention to develop a method of the kind described initially such that, using inexpensive machine units for the production of the articles, the additional means required for packing can be reduced substantially and, at the same time, fully automatic packing of the articles can be achieved regardless of whether the packages have one, two or more rows.

This object is met, in accordance with the invention, by the following steps:

the articles are piled up in the machine units to form stacks of articles, the stacks of articles are transferred to a conveyor means operating in cycles, the stacks of articles are conveyed to the cartoning machine, the stacks of articles are pushed into a box transversely of the direction of transport, one, two or more such stacks being pushed into the box.

It is advantageous to move the stacks of articles into a position suitable for cartoning, preferably by turning them prior to the transfer to the conveyor means.

The invention also comprises an installation for carrying out the method. In this installation a stacking device for forming stacks of articles and a transverse pusher are associated with each machine unit, the machine units being interconnected by a common compartmental conveyor moved in cycles and having compartments of the length of a stack of articles. At standstill these compartments are aligned with the transverse pushers. And a cartoning machine is arranged at the end of the compartmental conveyor of this installation, as seen in the direction of movement, another transverse pusher being coordinated with said cartoning machine so as to be aligned with the compartments of the compartmental conveyor at standstill.

In accordance with a further development of the invention the stacking device is designed as a turning device or combined with such a turning device so as to transfer the stacks of articles into the compartmental conveyor in the proper position for the subsequent cartoning.

The invention also comprises the package produced according to the method, the box of this package receiving at least one stack of articles.

BRIEF DESCRIPTION OF THE DRAWING

The invention is shown, by way of example, in the accompanying drawing and will be described below. In the drawing.

DETAILED DESCRIPTION

Figure 1:
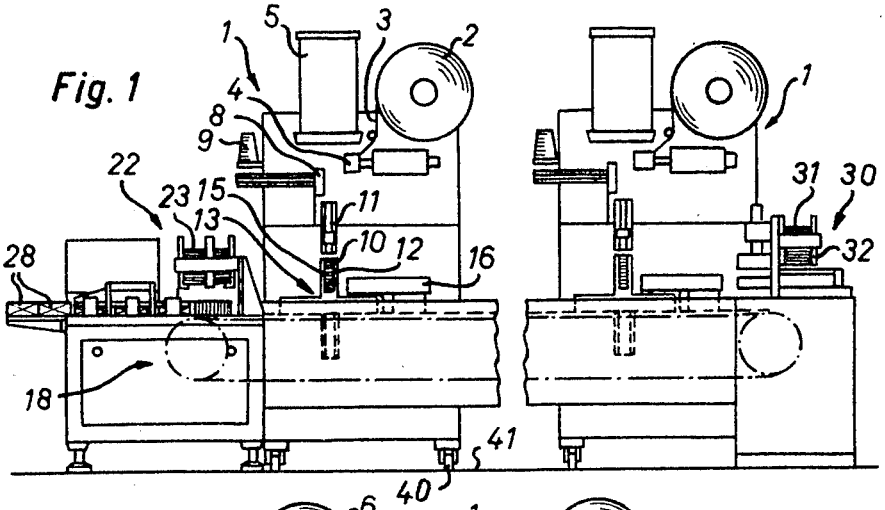
FIG. 1 shows an installation for the automatic packing of articles which are being produced in at least two machine units.
Figure 2:
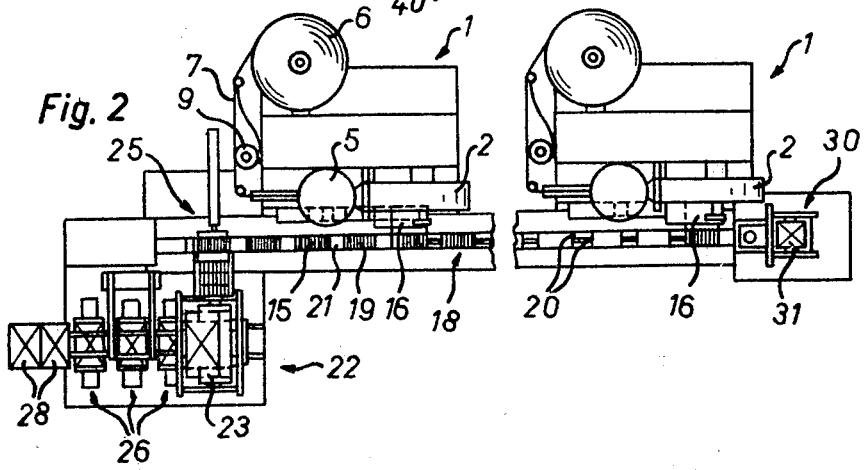
FIG. 2 is a top view of the installation shown in FIG. 1.

The installation for automatic packing of articles shown in FIGS. 1 and 2 comprises a number of machine units 1 for producing articles, two such units being shown. The machine unit 1 may be of different design, depending on the article to be produced. In FIG. 1 it is assumed that a bag-like structure is produced, filled with a certain amount of a material, and provided with a label. Therefore, the machine unit 1 comprises a roll of foil or film 2 from which the film 3 is unwound and processed in a folding and/or sealing unit to a bag-like structure. A certain amount of material is filled in a manner not shown from a material container 5 into the bag-like structure, and then the structure is sealed.

FIG. 2 shows a roll of labels 6 from which a label band 7 is unwound. Yarn unwound from a roll of yarn 9 is fixed to the label by means of a clamp and then connected with the structure at a connecting station 8. The finished article 10 is taken over by a gripper 11 and piled up to a stack of articles 15 in an arm 12 of a turnstile 13. Then the turnstile 13 is rotated through a certain angle depending on the number of arms 12, e.g. through 90° so that the stack of articles 15 can be slid into a transverse pusher 16 which at the same time also serves as intermediate storage member. The stack of articles 15 thus has been brought into a position suitable for the subsequent cartoning.

As may be taken from FIG. 2, a compartmental chain 18 indicated in FIG. 1 in dash-dot lines as a chain or belt drive is associated with the machine units 1. The compartments 19 of said chain have a length corresponding to a stack of articles 15, and they are separated from each other by intermediate walls 20, possibly with empty spaces 21 located in the interior. The compartmental chain 18 is moved in cycles and, at standstill, the compartments 19 are aligned with the transverse pusher 16 of each machine unit 1 so that the stack of articles 15 positioned in the transverse pusher 16 can be pushed into the corresponding compartment.

The compartmental chain 18 moves the stacks of articles 15 in cycles in the direction toward a cartoning machine 22. The cartoning machine comprises a stack of folding cartons 23 which are removed successively from the stack and erected such that they can be filled with the arriving stacks of articles 15. For this purpose another transverse pusher 25 is provided at the end of the compartmental chain 18 so as to be aligned with the compartments 19 at standstill and to push the stacks of articles 15 either one after the other into the prepared folding cartons 23 or to collect the desired number of rows of articles in an intermediate storage means out of which they will then be pushed into the folding boxes 23. One or two or more stacks of articles 15 may be pushed into one box, depending on the size of the folding boxes 23. Upon being filled the cartons 23 are closed in various steps at downstream stations 26, and the finished packages 28 are removed subsequently.

By virtue of this arrangement of the machine units and their linking by means of the compartmental chain 18 a single cartoning machine 22 is sufficient for large-scale production. This cartoning machine is adapted to fill the stacks of articles 15 supplied successively by the compartmental chain 18 in any desired manner into boxes and then close them to form packages. Even if one machine unit 1 should fail, operation of the installation may be continued without any difficulty.

To provide for continuous discharge of the stacks of articles 15, a distance M must be observed between two adjacent transverse pushers 16. This distance depends on the number n of machine units disposed in one row, the length z of the stacks of articles 15 or of the compartments 19, and the widths w of the intermediate walls 20 and s of the empty gap 21: $M=(n-1)\cdot(z+w+s)$ or a multiple thereof, i.e., for instance with six machine units 1 the distance between two transverse pushers 16 corresponds to five compartmental divisions or a multiple thereof. The loading of the compartments 19 with the stacks of articles 15 is effected at each machine unit 1 after each sixth cycle or a multiple thereof, i.e. after the chain has been displaced by six compartmental divisions or a multiple thereof. This makes it possible for all compartments 19 to be filled with stacks of articles 15 at the end of the compartmental chain 18. It is also possible to dispose the machine units 1 at both sides of the chain conveyor, the resulting total length of the installation thus being shorter. It is only required that a certain compartment remain associated with each transverse pusher.

If boxes are filled with a plurality of stacks of articles 15 in the installation described, the individual stacks of articles 15 must not be mixed up by vibration during transport. Therefore, a film feeding device 30 is provided at the beginning of the compartmental chain 18 by means of which device guiding film 31 may be removed from a band or stack 32, folded, and inserted into the compartments 19 of the compartmental chain 18 before the stacks of articles 15 are pushed into the compartments 19 by the transverse pushers 16. The guiding film 31 is L- or U-shaped, i.e. this film forms one or two sidewalls for the stacks of articles 15. The individual pieces of film have approximately the same length as the compartments. This furnishing of the stack of articles 15 with a guiding film 31 does not influence the pushing of the stack of articles by the further transverse pusher 25. On the other hand, however, the individual stacks of articles 15 in the boxes 23 are divided and held by the sidewalls of the guiding film 31 so that they can no longer be mixed up by vibration.

As the stacks of articles 15 are supplied together with guiding film 31, it is possible to use folding cartons 23 similar to customary folding cartons for the packing of the stacks of articles 15.

Figure 3:
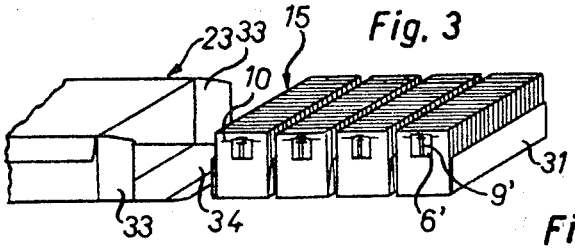
FIG. 3 is a perspective view of a box with the corresponding stacks of articles prior to filling.

The introduction of the stacks of articles 15 provided with guiding film 31 into a folding carton 23 will be explained with reference to FIGS. 3 and 4. First the folding carton 23 is erected in the cartoning machine 22, see FIG. 3, side panels 33 and an insertable tongue 34 forming an opening through which the stacks of articles 15 are pushed in. The individual stacks of articles 15 whose articles 10 comprise a label 6' with a piece of yarn 9' and their guiding films 31 are either placed in position in front of the carton 23 by the further transverse pusher 25, see FIG. 3, or are pushed directly into the carton 23. If the stacks of articles 15 are placed in front of the carton 23, the stacks of articles 15 will be pushed into the carton 23 by means provided in the cartoning machine 22.

Figure 4:
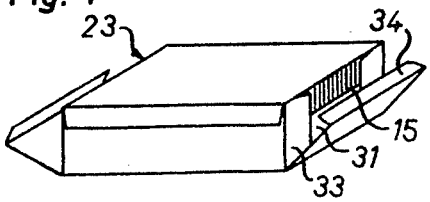
FIG. 4 is a perspective view of the box shown in FIG. 3 with the stacks of articles pushed in and prior to the gluing of the covering lugs.

FIG. 4 shows the carton 23 partly packed. The side panels 33 and/or the insertable tongues 34 are provided with an adhesive, and then the insertable tongue 34 is inserted over the side panels 33 which have already been folded up, thus providing a finished transportable package whose stacks of articles 15 are retained in position without any change.

Figure 5:
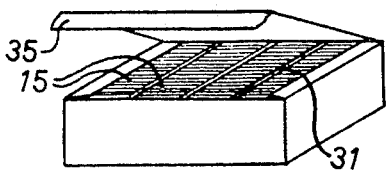
FIG. 5 shows the box according to FIG. 4 with glued-on covering lugs and the lid already open for removal of the articles.

FIG. 5 shows the finished package with rows of stacks of articles 15 separated by guiding film 31 upon opening of the lid 35 which is glued on the outside in contrast to the conventional folding cartons and may be provided in addition with a perforation. It serves as a tear open tab which is used as an insertable tab for renewed closing.

The installation described may be modified within the scope of the invention. The machine units 1 which are displaceable by rollers 40 may also be supported firmly on the bottom 41, such as shown for the cartoning machine 22. The machine units 1 need not be placed in a straight line but instead may be positioned in accordance with the available space. Of course, the compartmental conveyor interconnecting the machine units 1 then must be of corresponding design. The compartmental conveyor 18 may also be embodied as a rotatable drum around which the machine units 1, the cartoning machine 22 and the film feeding device 30 are disposed. It is essential that only a single cartoning machine 22 and a single film feeding device 30 must be used irrespective of the number of machine units 1 employed. The film feeding device 30 may be dispensed with if packages are produced with but one stack of articles.

What I claim is:

1. A method for automatically packing into cartons articles produced by at least two machines, which comprises the steps of (a) arranging the articles produced by each machine in a vertical stack;

(b) turning the stacks about parallel horizontal axes toward given loading orientations relative to the vertical;

(c) laterally displacing each of said stacks, while in said given loading orientation, toward linearly arranged spaced loading stations;

(d) conveying said stacks, while in said given loading orientation, successively in a step-by-step manner along a linear path extending from said loading stations to a carton filling station, said stacks being turned in synchronism with the step-by-step conveying operation; and (e) laterally displacing successive stacks, while in said given loading orientation, from said carton filling station into cartons supported adjacent thereto.

2. The method defined in claim 1, and further including the preliminary step of partially enclosing at least the bottom portion of each stack in a sheet of guiding film, thereby to facilitate introducing the stack of articles into the cartons.

3. Apparatus for automatically packing into cartons articles produced by at least two machines, comprising (a) means for arranging the articles produced by each machine in a vertical stack;

(b) means (13) for rotating the stacks about parallel horizontal axes toward given loading orientations relative to the vertical;

(c) first pusher means (16) for laterally displacing each of the stacks, while in the given loading orientation, toward linearly arranged spaced loading stations;

(d) compartmented conveyor means (18) for conveying said stacks, while in said loading orientation, in a step-by-step manner along a linear path extending from said loading stations to a carton filling station, said stacks being rotated to the loading orientation in synchronism with the step-by-step conveyor operation; and (e) second pusher means (25) for laterally displacing successive stacks, while in said given loading orientation, from said carton filling station into cartons supported adjacent thereto.

4. Apparatus as defined in claim 3, and further including (f) means (30) for supplying guiding film to said conveyor means for receiving at least the bottom portion of each stack of articles, thereby to align and hold together the stacks of articles.

5. Apparatus as defined in claim 4, wherein the size of the stacks corresponds with the size of the conveyor compartments, said guiding film including portions having approximately the same length as the conveyor compartment and extending over the bottom of the compartment and at least one side of the stack of articles.

* * * * *